US011217876B2

(12) United States Patent
Chang et al.

(10) Patent No.: US 11,217,876 B2
(45) Date of Patent: Jan. 4, 2022

(54) RECEIVING DEVICE

(71) Applicant: Wistron NeWeb Corp., Hsinchu (TW)

(72) Inventors: Yuan-Li Chang, Hsinchu (TW); Chun-Chia Kuo, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 80 days.

(21) Appl. No.: 16/700,089

(22) Filed: Dec. 2, 2019

(65) Prior Publication Data

US 2020/0365970 A1 Nov. 19, 2020

(30) Foreign Application Priority Data

May 16, 2019 (TW) ..... 108116874

(51) Int. Cl.
*H01Q 1/22* (2006.01)
*H01Q 1/24* (2006.01)
*H01Q 1/42* (2006.01)

(52) U.S. Cl.
CPC ..... *H01Q 1/243* (2013.01); *H01Q 1/2216* (2013.01); *H01Q 1/42* (2013.01)

(58) Field of Classification Search
CPC ..... H01Q 1/243; H01Q 1/2216; H01Q 1/42; H01Q 1/425; H01Q 1/422; H01Q 13/206; H01Q 1/2225; H01Q 21/00; H01Q 21/30; H01Q 21/29
USPC ..... 343/702; 235/380, 381, 383, 385
See application file for complete search history.

(56) References Cited

U.S. PATENT DOCUMENTS 7,806,333 B1 * 10/2010 McReynolds ..... G06K 7/0008 235/450
8,770,479 B1 * 7/2014 Shoenfeld ..... G07F 17/0092 235/385
2008/0314980 A1 * 12/2008 Folcke ..... H01Q 7/04 235/385
2009/0231140 A1 * 9/2009 Hong ..... H01Q 1/38 340/572.7
2010/0060457 A1 * 3/2010 Burnside ..... H01Q 21/005 340/572.7
2010/0187307 A1 * 7/2010 Phillips ..... G06K 7/10316 235/385

(Continued)

FOREIGN PATENT DOCUMENTS

TW 201112983 A 4/2011

*Primary Examiner* — Thien T Mai
(74) *Attorney, Agent, or Firm* — McClure, Qualey & Rodack, LLP

(57) ABSTRACT

A receiving device is provided. The receiving device is adapted to receive a plurality of objects, wherein each object includes an RFID. The receiving device includes a device housing, a plurality of spacing shelves and a plurality of reading antenna modules. The spacing shelves are disposed in the device housing, wherein the spacing shelves define a plurality of receiving spaces in the device housing, and at least some of the receiving spaces overlap each other. The reading antenna modules are respectively disposed in the receiving spaces, and are adapted to read the RFIDs of the objects. The device housing includes an inner wall and an opening. The inner wall includes a first wall, a second wall and a third wall. The first wall faces the third wall. The second wall faces the opening. The reading antenna modules are disposed on the inner wall.

15 Claims, 9 Drawing Sheets

(56) References Cited

U.S. PATENT DOCUMENTS

2015/0115029 A1* 4/2015 Rahim ..... G07F 17/0092
235/385
2016/0055447 A1* 2/2016 Sehmer ..... G06K 7/10415
235/385

* cited by examiner

RECEIVING DEVICE

CROSS REFERENCE TO RELATED APPLICATIONS

This Application claims priority of Taiwan Patent Application No. 108116874, filed on May 16, 2019, the entirety of which is incorporated by reference herein.

BACKGROUND OF THE INVENTION

Field of the Invention

The present invention relates to a receiving device, and in particular to a receiving device with reading antenna modules.

Description of the Related Art

Radio frequency identification (RFID) technology is widely used in warehouse management. Conventionally, there are a plurality of spacing shelves disposed in a receiving device. A plurality of objects are disposed on the spacing shelves. Each object includes an RFID. Since the objects are closely arranged, the reading antenna module inside the receiving device cannot accurately read the RFID of each object.

BRIEF SUMMARY OF THE INVENTION

In one embodiment, a receiving device is provided. The receiving device is adapted to receive a plurality of objects, wherein each object comprises an RFID. The receiving device includes a device housing, a plurality of spacing shelves and a plurality of reading antenna modules. The plurality of spacing shelves is disposed in the device housing, wherein the spacing shelves define a plurality of receiving spaces in the device housing, and the receiving spaces at least partially overlap with each other on a projection plane. The reading antenna modules are respectively disposed in the receiving spaces, and are capable of reading the RFID tags of the objects. The device housing has an inner wall and an opening, the inner wall comprises a first wall, a second wall, and a third wall, the first wall faces the third wall, the second wall faces the opening, and the reading antenna modules are disposed adjacent to the inner wall.

In one embodiment, the spacing shelves comprise a first shelf, the receiving spaces comprise a first receiving space, the first shelf defines the first receiving space, the reading antenna modules comprise a first reading antenna module, the first reading antenna module is located in the first receiving space, and the first reading antenna module is disposed on the first wall.

In one embodiment, the first reading antenna module is only disposed in the first receiving space, the first reading antenna module is only disposed on the first wall, the spacing shelves comprise a second shelf, the receiving spaces comprise a second receiving space, the first shelf and the second shelf define the second receiving space, the reading antenna modules comprise a second reading antenna module, the second reading antenna module is only located in the second receiving space, and the second reading antenna module is only disposed on the second wall.

In one embodiment, the spacing shelves comprise a third shelf, the receiving spaces comprise a third receiving space, the second shelf and the third shelf define the third receiving space, the reading antenna modules comprise a third reading antenna module, the third reading antenna module is only located in the third receiving space, and the third reading antenna module is only disposed on the third wall.

In one embodiment, the first reading antenna module is disposed on the first wall and the second wall.

In one embodiment, the first reading antenna module is only disposed in the first receiving space, the first reading antenna module is only disposed on the first wall and the second wall, the spacing shelves comprise a second shelf, the receiving spaces comprise a second receiving space, the first shelf and the second shelf define the second receiving space, the reading antenna modules comprise a second reading antenna module, the second reading antenna module is only located in the second receiving space, and the second reading antenna module is only disposed on the second wall and the third wall.

In one embodiment, the first reading antenna module is disposed on the first wall, the second wall and the third wall.

In one embodiment, the first reading antenna module is only disposed in the first receiving space, the spacing shelves comprise a second shelf, the receiving spaces comprise a second receiving space, the first shelf and the second shelf define the second receiving space, the reading antenna modules comprise a second reading antenna module, the second reading antenna module is only located in the second receiving space, and the second reading antenna module is disposed on the first wall, the second wall and the third wall, wherein on a first projection plane parallel to the spacing shelves, the first reading antenna module only partially overlaps the second reading antenna module, and the second reading antenna module only partially overlaps the first reading antenna module.

In one embodiment, each reading antenna module comprises a plurality of radiators, the first reading antenna module comprises a first radiator, a second radiator and a third radiator, the first radiator is disposed on the first wall, the second radiator is disposed on the second wall, and the third radiator is disposed on the third wall, wherein on a second projection plane parallel to the first wall and the third wall, the first radiator mismatches the third radiator.

In one embodiment, the distance between the first radiator and the third radiator is shorter than three meters.

In one embodiment, the first reading antenna module comprises a first curved section and a second curved section. The first curved section is facing in a first direction. The second curved section is facing in a second direction. The first direction is opposite the second section. The second curved section is located between the first curved section and the first shelf in a vertical direction.

In one embodiment, the first curved section comprises a crest point, the second curved section comprises a trough point, a first distance is formed between the trough point and the first shelf in the vertical direction, a second distance is formed between the crest point and the trough point in the vertical direction, and the ratio of the first distance to the second distance is 0.065~35.

In one embodiment, the first curved section has a first curvature radius and a first curvature center, a third distance is formed between the first curvature center and the first shelf, and the ratio of the third distance to the first curvature radius is 0.4~625.

In one embodiment, the receiving device further comprises a glass door, the glass door pivots on the device housing and is adapted to close the opening, the device housing is made of metal, and the glass door comprises metal material.

In one embodiment, a gap is formed between each reading antenna module and the inner wall, and the gap is 3.5 cm~4.5 cm.

In one embodiment, the receiving device further comprises at least one dielectric material, the dielectric material is disposed between at least one of the reading antenna modules and the inner wall, and a dielectric constant of the dielectric material is 0.76~1.35.

In the embodiments of the invention, each receiving space has one reading antenna module disposed therein, and the reading antenna module read the RFIDs of the objects. The identification rate of the RFIDs of the objects can be improved.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
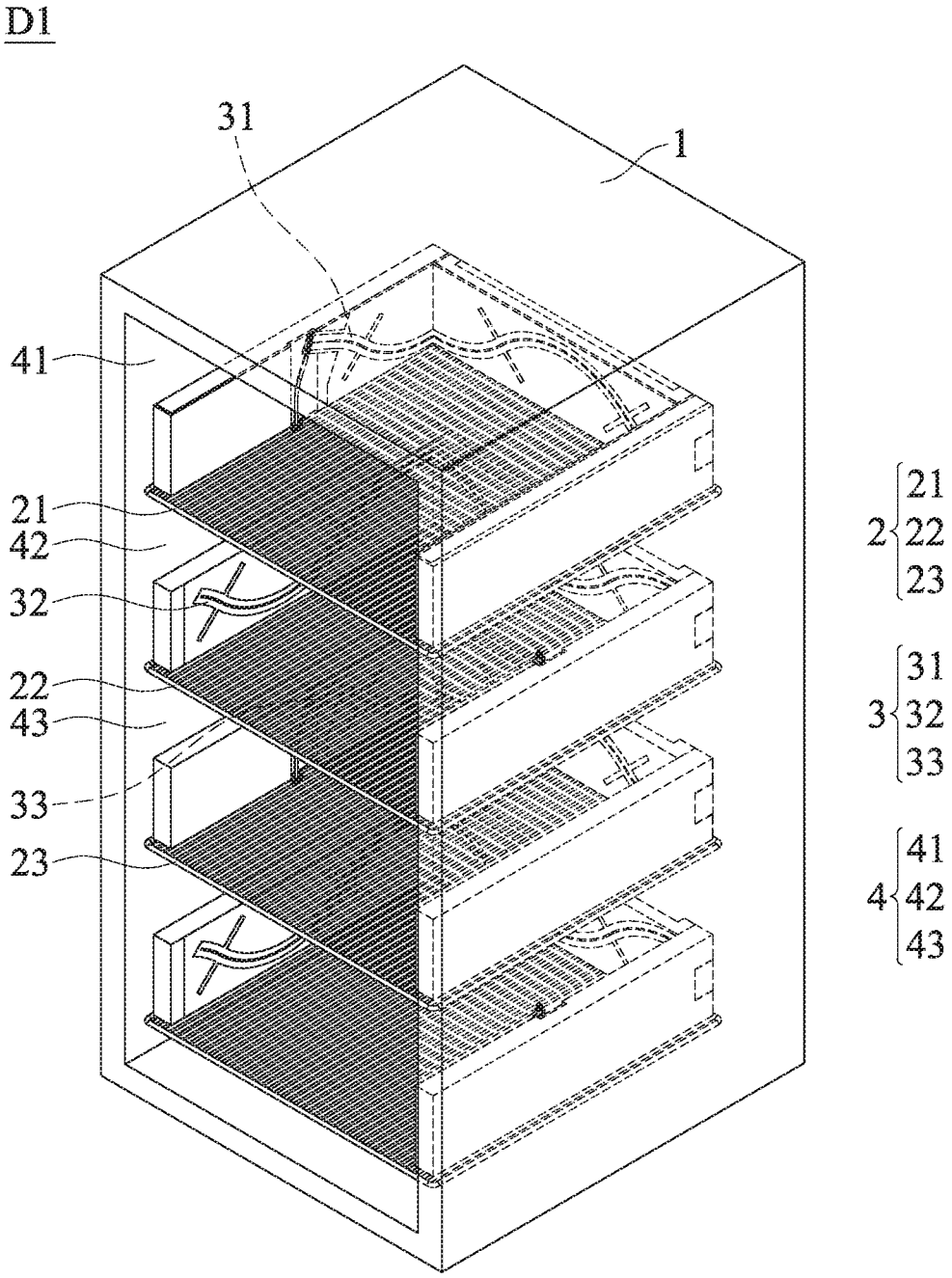
FIG. 1A is a perspective view of a receiving device of a first embodiment of the invention.

FIG. 1A is a perspective view of a receiving device D1 of a first embodiment of the invention. The receiving device D1 is adapted to receive a plurality of objects (not shown), wherein each object comprises an RFID (not shown). The receiving device D1 includes a device housing 1, a plurality of spacing shelves 2 and a plurality of reading antenna modules 3. The spacing shelves 2 are disposed in the device housing 1, wherein the spacing shelves 2 define a plurality of receiving spaces 4 in the device housing 1. At least some of the receiving spaces 4 overlap each other. The reading antenna modules 3 are respectively disposed in the receiving spaces 4, and are adapted to read the RFIDs of the objects.

Figure 2A:
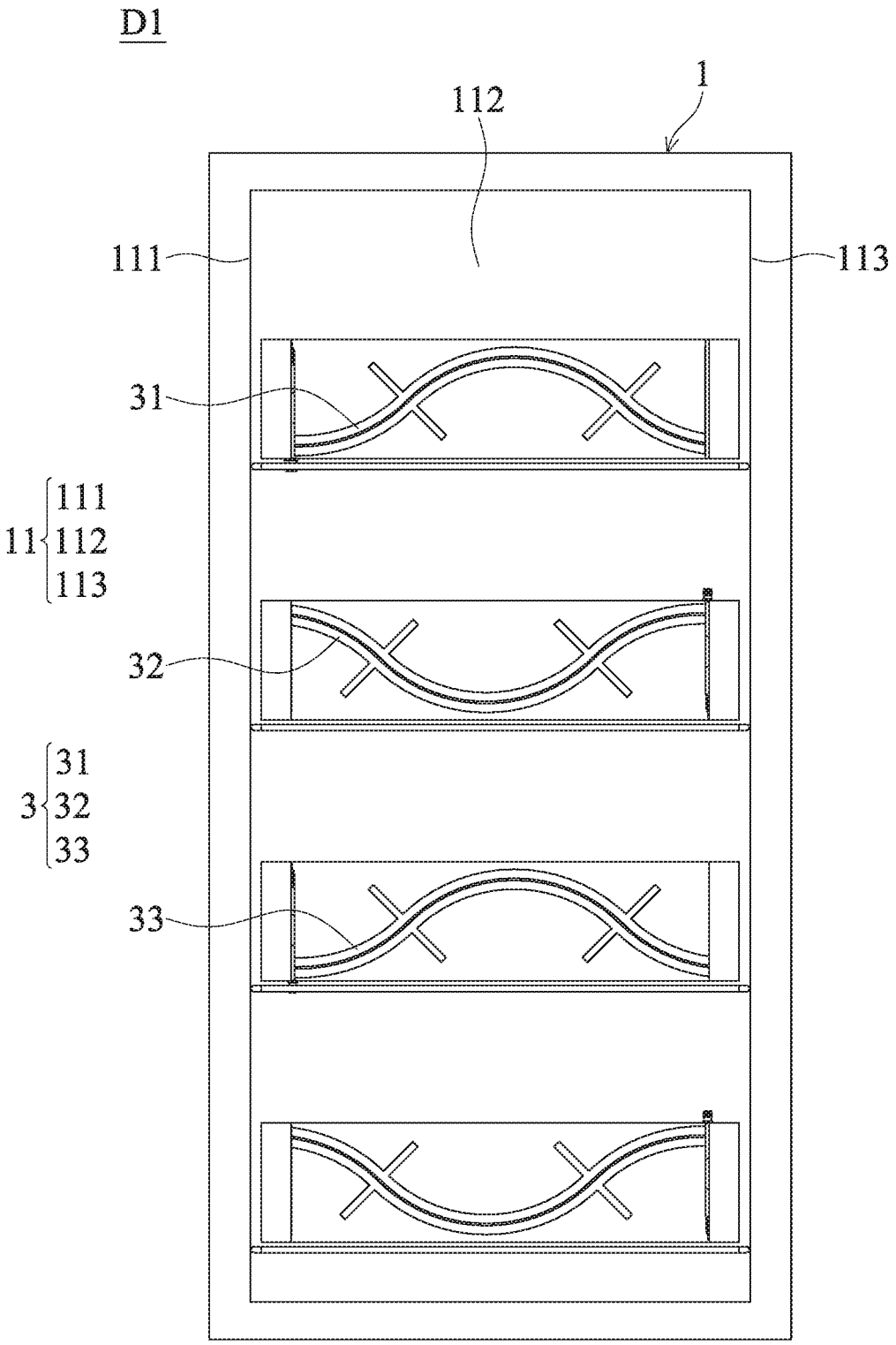
FIG. 2A is a front view of the receiving device of the first embodiment of the invention.
Figure 2B:
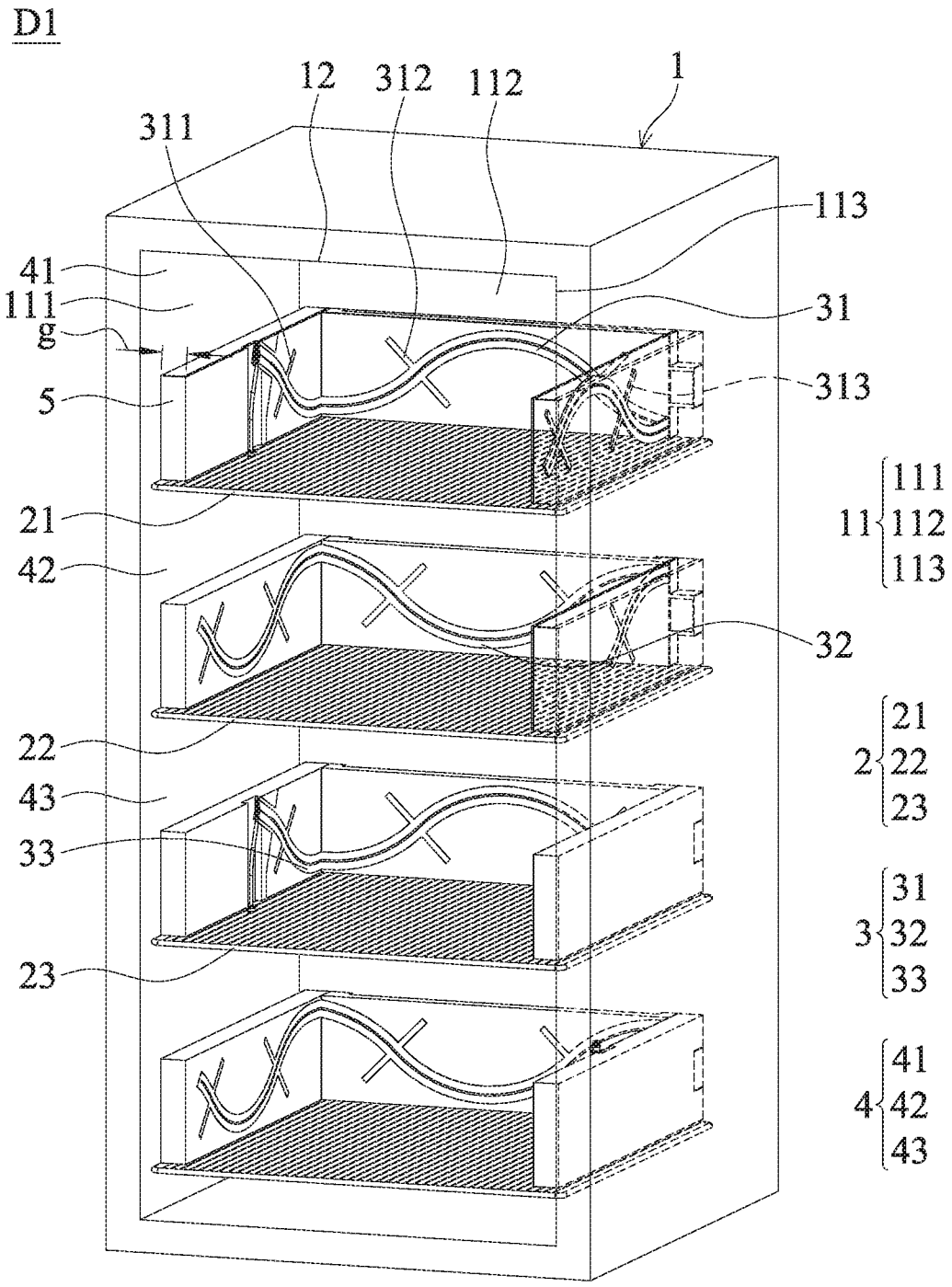
FIG. 2B shows the details of the receiving device of the first embodiment of the invention.

FIG. 2A is a front view of the receiving device D1 of the first embodiment of the invention. FIG. 2B shows the details of the receiving device D1 of the first embodiment of the invention. With reference to FIGS. 2A and 2B, in one embodiment, the device housing 1 comprises an inner wall 11 and an opening 12. The inner wall 11 comprises a first wall 111, a second wall 112 and a third wall 113. The first wall 111 faces the third wall 113. The second wall 112 faces the opening 12. The reading antenna modules 3 are disposed on the inner wall 11.

With reference to FIGS. 1A, 2A and 2B, in one embodiment, the spacing shelves 2 comprises a first shelf 21. The receiving spaces 4 comprise a first receiving space 41. The first shelf 21 defines the first receiving space 41. The reading antenna modules 3 comprise a first reading antenna module 31. The first reading antenna module 31 is located in the first receiving space 41. The first reading antenna module 31 is disposed on the first wall 111, the second wall 112 and the third wall 113.

With reference to FIGS. 1A, 2A and 2B, in one embodiment, the first reading antenna module 31 is only disposed in the first receiving space 41. The spacing shelves 2 comprise a second shelf 22. The receiving spaces 4 comprise a second receiving space 42. The first shelf 21 and the second shelf 22 define the second receiving space 42. The reading antenna modules 3 comprise a second reading antenna module 32. The second reading antenna module 32 is only located in the second receiving space 42. The second reading antenna module 32 is disposed on the first wall 111, the second wall 112 and the third wall 113.

In the first embodiment of the invention, each receiving space has one reading antenna module disposed therein, and the reading antenna module read the RFIDs of the objects. The identification rate of the RFIDs of the objects can be improved. Particularly, the reading antenna module is disposed on the first wall, the second wall and the third wall, and surrounds the objects in a U-shaped arrangement. Therefore, the identification rate of the RFIDs of the objects can be improved.

In one embodiment, each receiving space having one reading antenna module disposed therein means that each receiving space has one reading antenna module disposed therein, the all radiators of the reading antenna module are in the corresponding receiving space. In another embodiment, the all radiators, conductive lines and the feed points of the reading antenna module are in the corresponding receiving space. The disclosure is not meant to restrict the invention.

In one embodiment, the identification rate of the RFIDs of the objects inside the receiving device can reach almost 100%.

Figure 3:
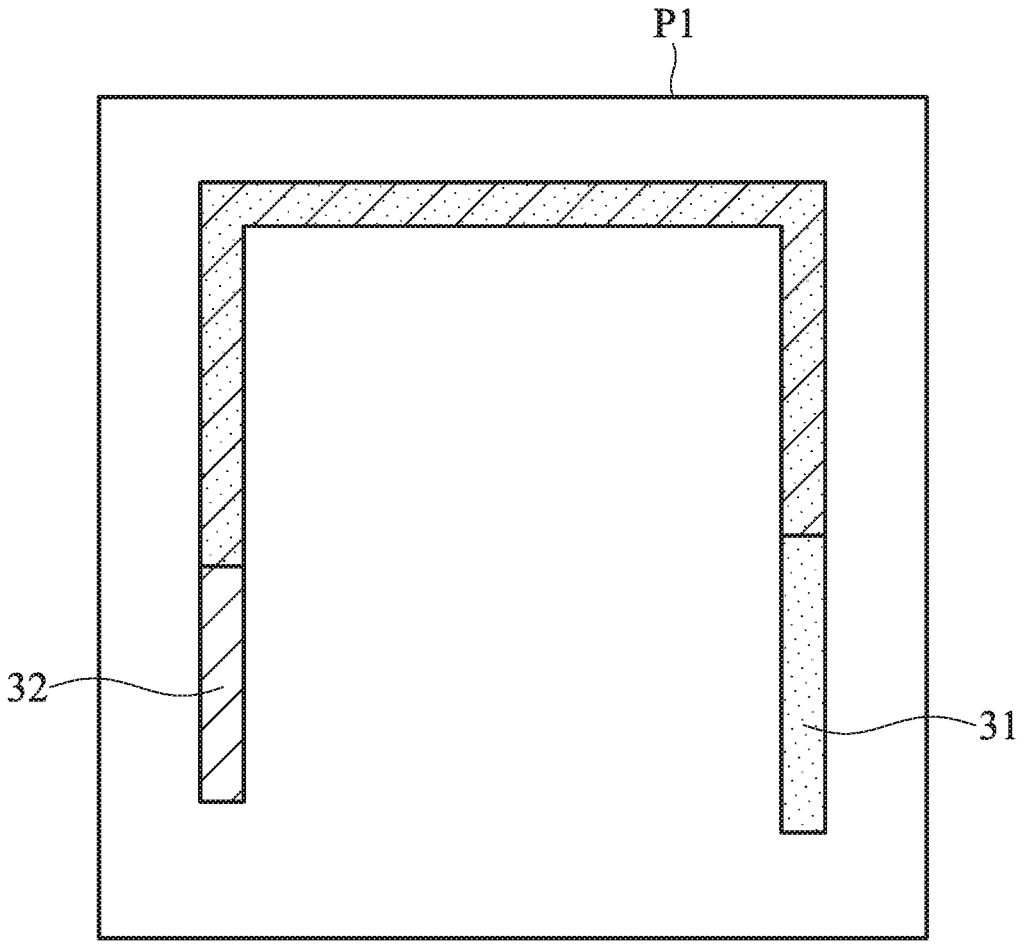
FIG. 3 shows the structure of the first embodiment of the invention projected on a first projection plane.

FIG. 3 shows a first projection plane of the first embodiment of the invention. With reference to FIG. 3, on the first projection plane P1 parallel to the spacing shelves, the first reading antenna module 31 only partially overlaps the second reading antenna module 32, and the second reading antenna module 32 only partially overlaps the first reading antenna module 31. To clarify the feature, FIG. 3 is only a schematic diagram showing the first reading antenna module 31 and the second reading antenna module 32. The disclosure is not meant to restrict the invention.

Figure 4:
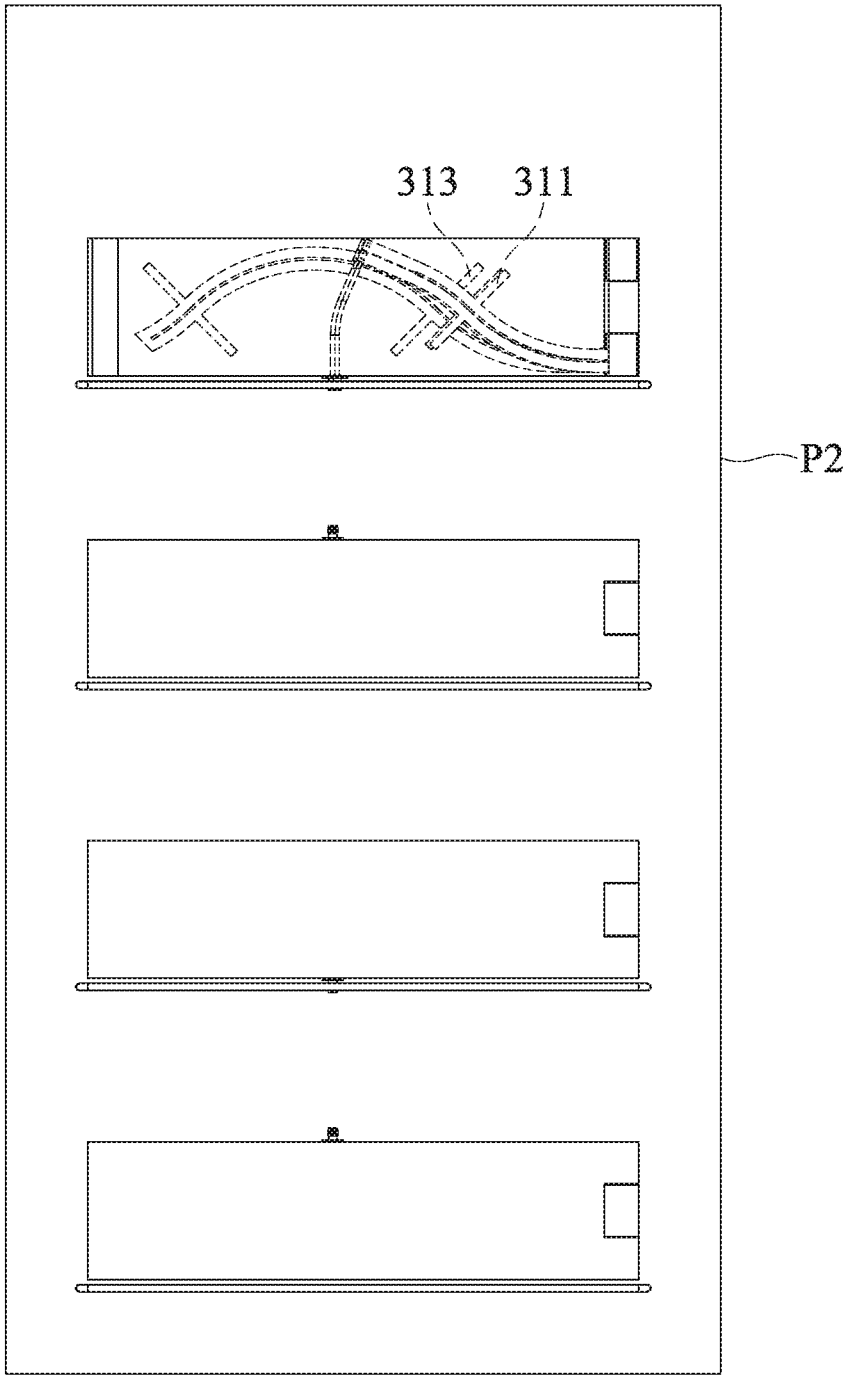
FIG. 4 shows the structure of the first embodiment of the invention projected on a second projection plane.

With reference to FIGS. 1A, 2A and 2B, in one embodiment, each reading antenna module comprises a plurality of radiators. The first reading antenna module 31 comprises a first radiator 311, a second radiator 312 and a third radiator 313. The first radiator 311 is disposed on the first wall 111, the second radiator 312 is disposed on the second wall 112, and the third radiator 313 is disposed on the third wall 113. With reference to FIG. 4, on a second projection plane P2 parallel to the first wall 111 and the third wall 113, the first radiator 311 mismatches the third radiator 313.

On the first projection plane P1, the first reading antenna module 31 only partially overlaps the second reading antenna module 32, and the second reading antenna module 32 only partially overlaps the first reading antenna module 31. Therefore, the identification toward the RFIDs of the objects can be obtained with fewer radiators. Additionally, on the second projection plane P2, the first radiator 311 mismatches the third radiator 313. Thus, the identification rate of the RFIDs of the objects is improved further.

With reference to FIGS. 1A, 2A and 2B, in one embodiment, the reading antenna modules 3 further include a third reading antenna module 33. The location of the third reading antenna module 33 can be corresponding to that of the first reading antenna module 31. Or, in another embodiment, the third reading antenna module 33 mismatches the first reading antenna module 31 and the second reading antenna module 32.

With reference to FIG. 2B, in one embodiment, when the power of the reading antenna module is 1W, the distance between the first radiator 311 and the third radiator 313 is less than three meters.

Figure 5:
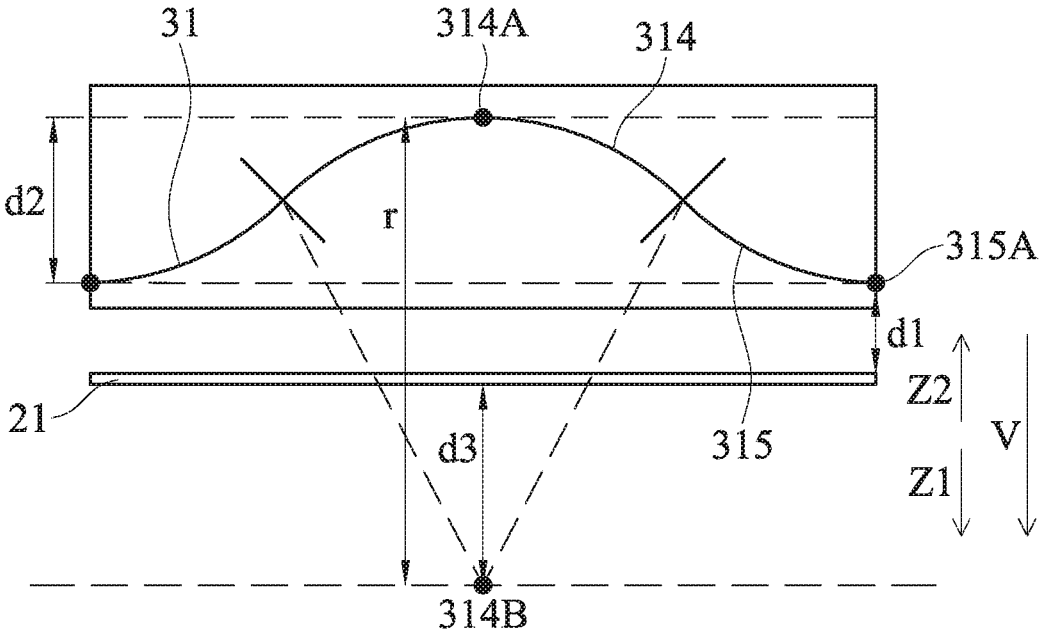
FIG. 5 shows the details of the reading antenna module of the embodiment of the invention.

With reference to FIG. 5, in one embodiment, the first reading antenna module 31 comprises a first curved section 314 and a second curved section 315. The first curved section 314 is facing in a first direction Z1. The second curved section 315 is facing in a second direction Z2. The first direction Z1 is opposite the second section Z2. The second curved section 315 is located between the first curved section 314 and the first shelf 21 in a vertical direction V.

With reference to FIG. 5, in one embodiment, the first curved section 314 comprises a crest point 314A. The second curved section 315 comprises a trough point 315A. A first distance d1 is formed between the trough point 315A and the first shelf 21 in the vertical direction V. A second distance d2 is formed between the crest point 314A and the trough point 315A in the vertical direction V. The ratio of the first distance d1 to the second distance d2 is 0.065~35. Within this ratio range, the blocking effect of the spacing shelves can be decreased, and the identification rate of the RFIDs of the objects is improved.

With reference to FIG. 5, in one embodiment, the first curved section 314 has a first curvature radius r and a first curvature center 314B. A third distance d3 is formed between the first curvature center 31B and the first shelf 21. The ratio of the third distance d3 to the first curvature radius r is 0.4~625. Within this ratio range, the blocking effect of the spacing shelves can be decreased, and the identification rate of the RFIDs of the objects is improved.

Figure 1B:
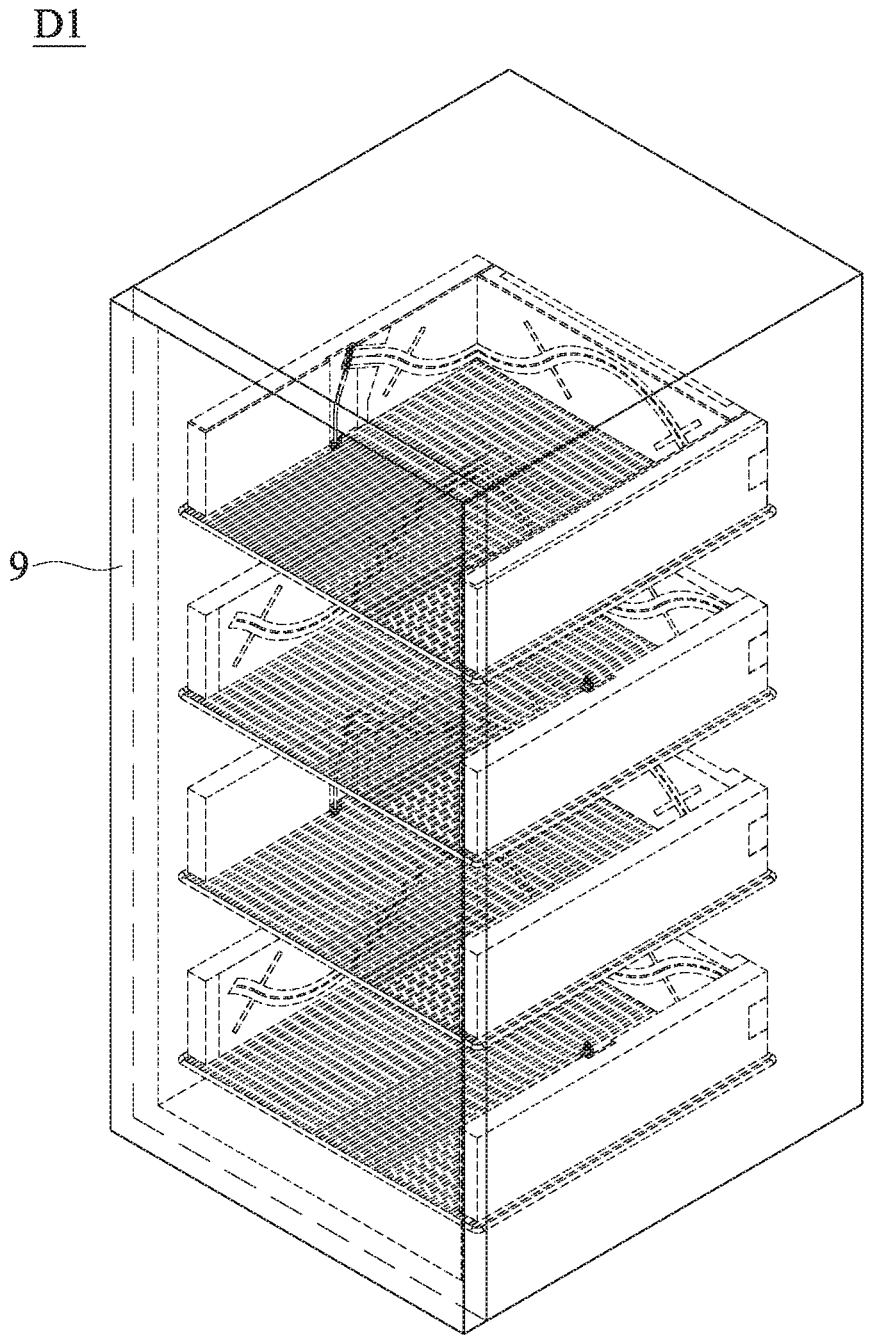
FIG. 1B shows a glass door of the first embodiment of the invention.

With reference to FIG. 1B, in one embodiment, the receiving device D1 further comprises a glass door 9. The glass door 9 pivots on the device housing 1 and is adapted to cover the opening. The device housing 1 is made of metal. The glass door 9 comprises metal material, which restricts the signal of the reading antenna modules in the receiving device D1. Therefore, the reading antenna modules can only read the RFIDs of the objects inside the receiving device D1.

With reference to FIG. 2B, in one embodiment, a gap g is formed between each reading antenna module 3 and the inner wall 11. The size of the gap g is 3.5 cm~4.5 cm. In this embodiment, the receiving device D1 further comprises at least one dielectric material 5. The dielectric material 5 is disposed between at least one of the reading antenna modules 3 and the inner wall 11. A dielectric constant of the dielectric material 5 is 0.76~1.35. In one embodiment, the dielectric material 5 is directly attached to the inner wall 11. The antenna modules 3 are directly attached to the surface of the dielectric material 5. Therefore, the identification rate of the RFIDs of the objects is improved even further. In one embodiment, the size of the each RFID is preferred 3 cm×1.5 cm. The RFID of this size can be successfully read inside the receiving device D1, and can be prevented from being read when the RFID is out of the receiving device D1.

Figure 6A:
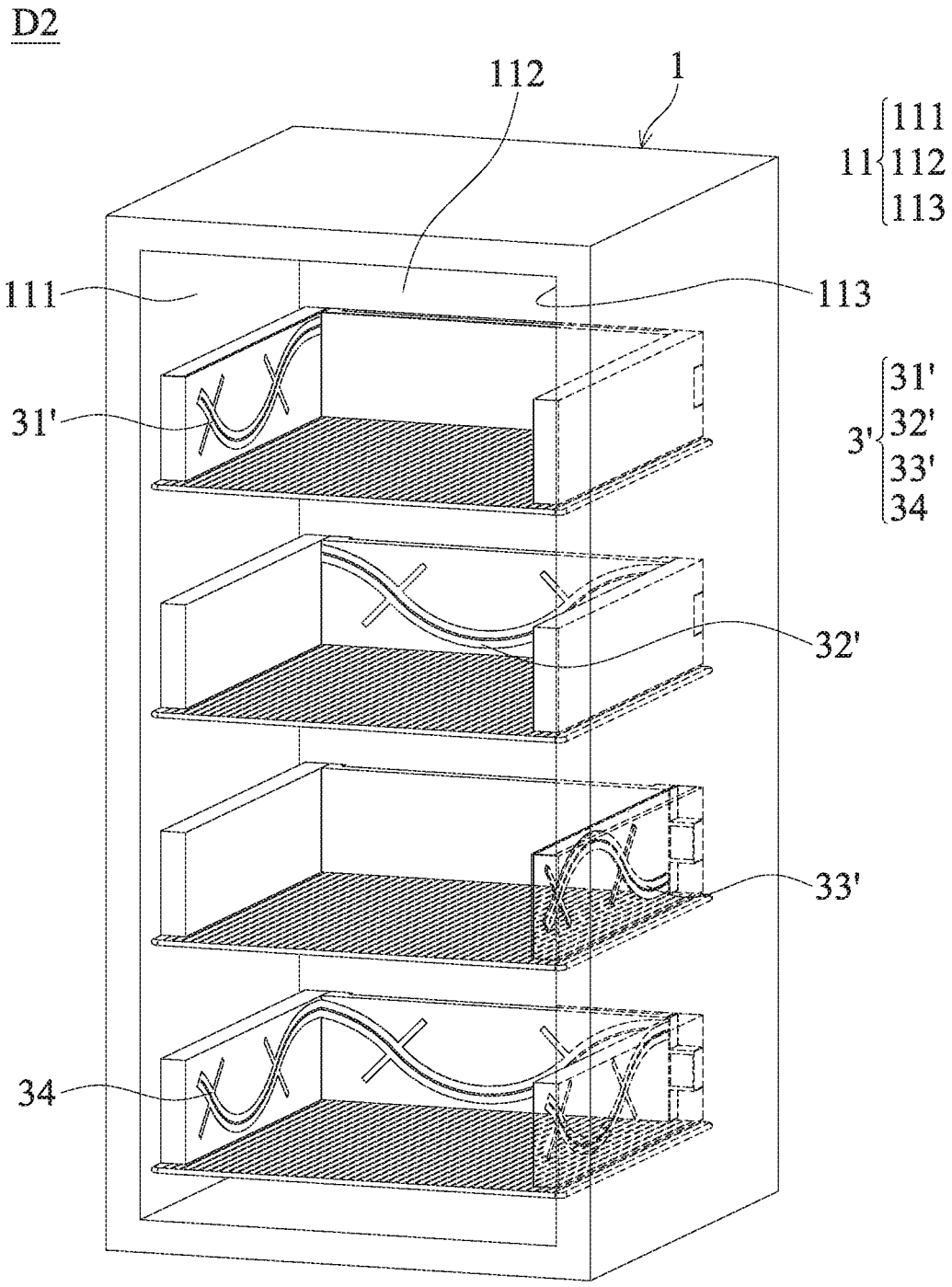
FIG. 6A shows a receiving device of a second embodiment of the invention.

FIG. 6A shows a receiving device D2 of a second embodiment of the invention. With reference to FIG. 6A, in this embodiment, the first reading antenna module 31' is only disposed in the first receiving space 41. The first reading antenna module 31' is only disposed on the first wall 111. The spacing shelves 2 comprise a second shelf 22. The receiving spaces 4 comprise a second receiving space 42. The first shelf 21 and the second shelf 22 define the second receiving space 42. The reading antenna modules 3' comprise a second reading antenna module 32'. The second reading antenna module 32' is only located in the second receiving space 42. The second reading antenna module 32' is only disposed on the second wall 112.

With reference to FIG. 6A, in this embodiment, the spacing shelves 2 comprise a third shelf 23. The receiving spaces 4 comprise a third receiving space 43. The second shelf 22 and the third shelf 23 define the third receiving space 43. The reading antenna modules 3' comprise a third reading antenna module 33'. The third reading antenna module 33' is only located in the third receiving space 43. The third reading antenna module 33' is only disposed on the third wall 113.

In the receiving device D2 of the second embodiment of the invention, the first reading antenna module 31' can read the RFID of the objects in the second receiving space 42 and the third receiving space 43. Similarly, the second reading antenna module 32' can read the RFID of the objects in the first receiving space 41 and the third receiving space 43, and the third reading antenna module 33' can read the RFID of the objects in the first receiving space 41 and the second receiving space 42. The first reading antenna module 31', the second reading antenna module 32' and the third reading antenna module 33' are respectively disposed on the first wall 111, the second wall 112 and the third wall 113, and read the RFIDs in different directions.

With reference to FIG. 6A, in this embodiment, a U-shaped arranged fourth reading antenna module 34 can be disposed in the receiving device D2 to provide improved identification rate.

Figure 6B:
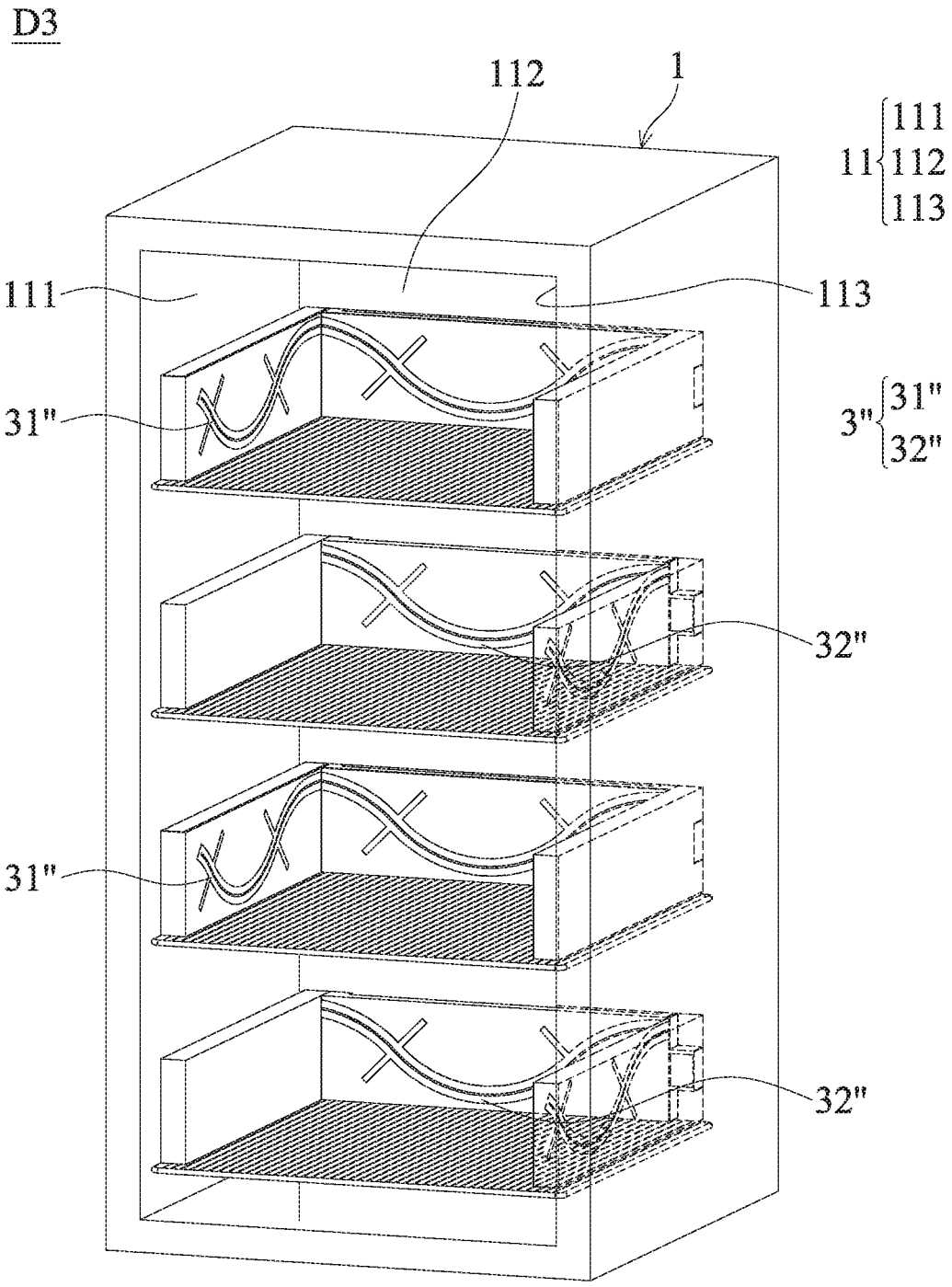
FIG. 6B shows a receiving device of a third embodiment of the invention.

FIG. 6B shows a receiving device D3 of a third embodiment of the invention. With reference to FIG. 6B, in this embodiment, the first reading antenna module 31" is disposed on the first wall 111 and the second wall 112. In this embodiment, the first reading antenna module 31" is only disposed in the first receiving space 41. The first reading antenna module 31" is only disposed on the first wall 111 and the second wall 112. The spacing shelves 2 comprise a second shelf 22. The receiving spaces 4 comprise a second receiving space 42. The first shelf 21 and the second shelf 22 define the second receiving space 42. The reading antenna modules 3" comprise a second reading antenna module 32". The second reading antenna module 32" is only located in the second receiving space 42. The second reading antenna module 32" is only disposed on the second wall 112 and the third wall 113.

In the receiving device D3 of the third embodiment of the invention, the first reading antenna module 31" can read the RFID of the objects in the second receiving space 42. Similarly, the second reading antenna module 32" can read the RFID of the objects in the first receiving space 41. The first reading antenna module 31' is disposed on the first wall 111 and the second wall 112, the second reading antenna module 32' is disposed on the second wall 112 and the third wall 113, and the first reading antenna module 31' and the second reading antenna module 32' therefore read the RFIDs in different directions.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A receiving device, adapted to receive a plurality of objects, each object having an RFID tag, the receiving device comprising:

a device housing;

a plurality of spacing shelves, disposed in the device housing, wherein the spacing shelves define a plurality of receiving spaces in the device housing, and the receiving spaces at least partially overlap with each other on a projection plane; and a plurality of reading antenna modules, wherein the reading antenna modules are respectively disposed in the receiving spaces, and are capable of reading the RFID tags of the objects, wherein the device housing has an inner wall and an opening, the inner wall comprises a first wall, a second wall, and a third wall, the first wall faces the third wall, the second wall faces the opening, and the reading antenna modules are disposed adjacent to the inner wall, wherein a gap is formed between each reading antenna module and the inner wall, and the gap is 3.5 cm~4.5 cm, wherein the spacing shelves comprises a first shelf, the receiving spaces comprises a first receiving space defined by the first shelf, the reading antenna modules comprise a first reading antenna module, the first reading antenna module is located in the first receiving space, and the first reading antenna module is disposed adjacent to the first wall, wherein the first reading antenna module is disposed adjacent to the first wall, the second wall and the third wall, wherein each reading antenna module comprises a plurality of radiators, the first reading antenna module comprises a first radiator, a second radiator, and a third radiator, the first radiator is disposed adjacent to the first wall, the second radiator is adjacent to the second wall, and the third radiator is disposed adjacent to the third wall, wherein on a second projection plane parallel to the first wall and the third wall, the first radiator mismatches the third radiator.

2. The receiving device as claimed in claim 1, wherein the first reading antenna module is only disposed in the first receiving space, the spacing shelves comprise a second shelf, the receiving spaces comprise a second receiving space sandwiched between the first shelf and the second shelf, the reading antenna modules comprise a second reading antenna module only located in the second receiving space, and the second reading antenna module is disposed along the first wall, the second wall and the third wall, wherein on a first projection plane parallel to the spacing shelves, the first reading antenna module only partially overlaps with the second reading antenna module, and the second reading antenna module only partially overlaps with the first reading antenna module.

3. The receiving device as claimed in claim 1, wherein a distance between the first radiator and the third radiator is shorter than three meters.

4. The receiving device as claimed in claim 1, wherein the first reading antenna module comprises a first curved section and a second curved section, the first curved section is facing in a first direction, the second curved section is facing in a second direction, the first direction is opposite the second section, the second curved section is located between the first curved section and the first shelf in a vertical direction.

5. The receiving device as claimed in claim 4, wherein the first curved section comprises a crest point, the second curved section comprises a trough point, a first distance is formed between the trough point and the first shelf in the vertical direction, a second distance is formed between the crest point and the trough point in the vertical direction, and a ratio of the first distance to the second distance is 0.065~35.

6. The receiving device as claimed in claim 4, wherein the first curved section has a first curvature radius and a first curvature center, a third distance is formed between the first curvature center and the first shelf, and a ratio of the third distance to the first curvature radius is 0.4~625.

7. The receiving device as claimed in claim 1, further comprising a glass door, wherein the glass door pivots on the device housing and is adapted to close the opening, the device housing is made of metal, and the glass door comprises metal material.

8. The receiving device as claimed in claim 7, further comprising at least one dielectric material, the dielectric material is disposed between at least one of the reading antenna modules and the inner wall, and a dielectric constant of the dielectric material is 0.76~1.35.

9. A receiving device, adapted to receive a plurality of objects, each object having an RFID tag, the receiving device comprising:

a device housing;

a plurality of spacing shelves, disposed in the device housing, wherein the spacing shelves define a plurality of receiving spaces in the device housing, and the receiving spaces at least partially overlap with each other on a projection plane; and a plurality of reading antenna modules, wherein the reading antenna modules are respectively disposed in the receiving spaces, and are capable of reading the RFID tags of the objects, wherein the device housing has an inner wall and an opening, the inner wall comprises a first wall, a second wall, and a third wall, the first wall faces the third wall, the second wall faces the opening, and the reading antenna modules are disposed adjacent to the inner wall, wherein the spacing shelves comprises a first shelf, the receiving spaces comprises a first receiving space defined by the first shelf, the reading antenna modules comprise a first reading antenna module, the first reading antenna module is located in the first receiving space, and the first reading antenna module is disposed adjacent to the first wall, wherein the first reading antenna module is disposed adjacent to the first wall, the second wall and the third wall, wherein each reading antenna module comprises a plurality of radiators, the first reading antenna module comprises a first radiator, a second radiator, and a third radiator, the first radiator is disposed adjacent to the first wall, the second radiator is adjacent to the second wall, and the third radiator is disposed adjacent to the third wall, wherein on a second projection plane parallel to the first wall and the third wall, the first radiator mismatches the third radiator.

10. The receiving device as claimed in claim 9, wherein a distance between the first radiator and the third radiator is shorter than three meters.

11. The receiving device as claimed in claim 9, wherein the first reading antenna module comprises a first curved section and a second curved section, the first curved section is facing in a first direction, the second curved section is facing in a second direction, the first direction is opposite the second section, the second curved section is located between the first curved section and the first shelf in a vertical direction.

12. The receiving device as claimed in claim 11, wherein the first curved section comprises a crest point, the second curved section comprises a trough point, a first distance is formed between the trough point and the first shelf in the vertical direction, a second distance is formed between the crest point and the trough point in the vertical direction, and a ratio of the first distance to the second distance is 0.065~35.

13. The receiving device as claimed in claim 11, wherein the first curved section has a first curvature radius and a first curvature center, a third distance is formed between the first curvature center and the first shelf, and a ratio of the third distance to the first curvature radius is 0.4~625.

14. The receiving device as claimed in claim 9, further comprising a glass door, wherein the glass door pivots on the device housing and is adapted to close the opening, the device housing is made of metal, and the glass door comprises metal material.

15. The receiving device as claimed in claim 14, further comprising at least one dielectric material, the dielectric material is disposed between at least one of the reading antenna modules and the inner wall, and a dielectric constant of the dielectric material is 0.76~1.35.

* * * * *